US008339431B2

(12) United States Patent
Sanbongi et al.

(10) Patent No.: US 8,339,431 B2
(45) Date of Patent: Dec. 25, 2012

(54) THERMAL HEAD AND PRINTER

(75) Inventors: Norimitsu Sanbongi, Chiba (JP); Toshimitsu Morooka, Chiba (JP); Keitaro Koroishi, Chiba (JP); Noriyoshi Shoji, Chiba (JP)

(73) Assignee: Seiko Instruments Inc. (JP)

( * ) Notice: Subject to any disclaimer, the term of this patent is extended or adjusted under 35 U.S.C. 154(b) by 158 days.

(21) Appl. No.: 12/928,261

(22) Filed: Dec. 7, 2010

(65) Prior Publication Data

US 2011/0141214 A1 Jun. 16, 2011

(30) Foreign Application Priority Data

Dec. 14, 2009 (JP) ..... 2009-283005

(51) Int. Cl.
*B41J 2/335* (2006.01)

(52) U.S. Cl. ..... 347/200; 347/202

(58) Field of Classification Search ..... 347/200, 347/202

See application file for complete search history.

(56) References Cited

U.S. PATENT DOCUMENTS 6,950,117 B2 * 9/2005 Shirakawa et al. ..... 347/200
2011/0025808 A1 * 2/2011 Sanbongi ..... 347/200

FOREIGN PATENT DOCUMENTS

JP 2007-083532 * 4/2007

* cited by examiner

*Primary Examiner* — Huan Tran
(74) *Attorney, Agent, or Firm* — Adams & Wilks

(57) ABSTRACT

Provided is a thermal head including an intermediate layer between a support substrate and an upper substrate, which is capable of suppressing heat dissipation toward the support substrate while maintaining printing quality. Employed is a thermal head (1) including: an upper substrate (5); a support substrate (3) bonded in a stacked state on one surface side of the upper substrate (5); a heating resistor (7) provided on another surface side of the upper substrate (5); and an intermediate layer (6) including a concave portion that forms a cavity portion (4) in a region corresponding to the heating resistor (7), the intermediate layer (6) being provided between the upper substrate (5) and the support substrate (3), in which the intermediate layer (6) is formed of a plate-shaped glass material having a lower melting point than melting points of the upper substrate (5) and the support substrate (3).

9 Claims, 3 Drawing Sheets

THERMAL HEAD AND PRINTER

BACKGROUND OF THE INVENTION

1. Field of the Invention

The present invention relates to a thermal head and a printer.

2. Description of the Related Art

There has been conventionally known a thermal head for use in printers, in which an intermediate layer is provided between a support substrate and an upper substrate and the intermediate layer has a cavity portion formed therein in a region corresponding to heating resistors (see, for example, Japanese Patent Application Laid-open No. 2007-83532).

In the thermal head disclosed in Japanese Patent Application Laid-open No. 2007-83532, the cavity portion formed in the intermediate layer functions as a heat-insulating layer of low thermal conductivity to reduce an amount of heat transferring from the heating resistors toward the support substrate, to thereby increase thermal efficiency and reduce power consumption.

In the thermal head disclosed in Japanese Patent Application Laid-open No. 2007-83532, when the support substrate is formed of a material having good thermal conductivity, such as silicon, ceramics (alumina), or a metal (aluminum or copper), in order to increase the thermal efficiency of the thermal head, the intermediate layer needs to have a certain degree of thickness for suppressing the heat dissipation toward the support substrate.

However, if the thickness of the intermediate layer is too large, the heat dissipation effect toward the support substrate is significantly reduced to raise a temperature of the upper substrate excessively, resulting in low printing quality. Therefore, in order to suppress the heat dissipation toward the support substrate while maintaining the printing quality, the thickness of the intermediate layer needs to be about several tens μm to 100 μm.

However, in the case of forming the intermediate layer by screen printing using a glass paste, there is an inconvenience that a glass thickness obtained after baking may be as small as about 5 μm to 20 μm. Alternatively, in the case of forming the intermediate layer by photolithography using a polymer resin, because the intermediate layer is soft and has a large coefficient of thermal expansion, there is an inconvenience that the intermediate layer may be transformed due to continuous heating or that a bonding force to the upper substrate may reduce due to thermal stress.

SUMMARY OF THE INVENTION

The present invention has been made in view of the above-mentioned circumstances, and it is an object thereof to provide a thermal head including an intermediate layer between a support substrate and an upper substrate, which is capable of suppressing heat dissipation toward the support substrate while maintaining printing quality.

In order to achieve the above-mentioned object, the present invention provides the following measures.

According to a first aspect of the present invention, there is provided a thermal head including: an upper substrate; a support substrate bonded in a stacked state on one surface side of the upper substrate; a heating resistor provided on another surface side of the upper substrate; and an intermediate layer including a concave portion that forms a cavity portion in a region corresponding to the heating resistor, the intermediate layer being provided between the upper substrate and the support substrate, in which the intermediate layer is formed of a plate-shaped glass material having a lower melting point than melting points of the upper substrate and the support substrate.

According to the first aspect of the present invention, the upper substrate provided with the heating resistor functions as a heat storage layer that stores heat generated from the heating resistor. Further, the intermediate layer including the concave portion that forms a cavity portion is provided between the upper substrate and the support substrate which are bonded to each other in the stacked state, to thereby form a cavity portion between the support substrate and the upper substrate. The cavity portion is formed in the region corresponding to the heating resistor and functions as a heat-insulating layer that blocks the heat generated from the heating resistor. Therefore, according to the first aspect of the present invention, the heat generated from the heating resistor may be prevented from transferring and dissipating toward the support substrate via the upper substrate. As a result, use efficiency of the heat generated from the heating resistor, that is, thermal efficiency of the thermal head may be increased.

Here, the intermediate layer is formed of the plate-shaped glass material having a lower melting point than the melting points of the upper substrate and the support substrate. Accordingly, the intermediate layer may be melted within such a temperature range as not to deform the upper substrate or the support substrate, to bond the upper substrate and the support substrate to each other. Then, because the intermediate layer is formed of the plate-shaped glass material, the intermediate layer may be formed at a predetermined thickness so that the heat dissipation toward the support substrate is reduced to increase the thermal efficiency of the thermal head while maintaining the printing quality. Further, because the intermediate layer is formed of the glass material, the intermediate layer may have the same coefficient of thermal expansion as that of the upper substrate, to thereby suppress lowering in bonding force to the upper substrate due to thermal transformation or thermal stress.

In the above-mentioned aspect, the intermediate layer may be formed at a thickness equal to or larger than 50 μm and equal to or smaller than 100 μm.

Because the thickness of the intermediate layer is equal to or larger than 50 μm and equal to or smaller than 100 μm, the heat dissipation toward the support substrate may be reduced to increase the thermal efficiency of the thermal head while maintaining the printing quality.

In the above-mentioned aspect, the intermediate layer may be formed of a plurality of laminated thin film layers of glass pastes by screen printing.

Because the glass paste is subjected to screen printing, the thin film layer with a thickness approximately ranging from 5 μm to 20 μm may be formed. When the screen printing is performed a plurality of times to laminate a plurality of the thin film layers, the intermediate layer may be formed at a thickness equal to or larger than 50 μm and equal to or smaller than 100 μm. Therefore, the heat dissipation toward the support substrate may be reduced to increase the thermal efficiency of the thermal head while maintaining the printing quality.

In the above-mentioned aspect, the intermediate layer may be formed of at least one laminated green sheet which is formed by sheeting a mixed material of glass powders and a binder.

Because the intermediate layer is formed of at least one laminated sheet-shaped green sheet, process accuracy on the thickness of the intermediate layer may be increased. Therefore, the intermediate layer may easily be formed at a thickness equal to or larger than 50 μm and equal to or smaller than 100 μm, to thereby reduce the heat dissipation toward the support substrate to increase the thermal efficiency of the thermal head while maintaining the printing quality.

In the above-mentioned aspect, the intermediate layer may be a thin plate glass formed into a thin plate shape.

Because the intermediate layer is formed of the thin plate glass formed into the thin plate shape, the process accuracy on the thickness of the intermediate layer may be increased. Therefore, the intermediate layer may easily be formed at a thickness equal to or larger than 50 μm and equal to or smaller than 100 μm, to thereby reduce the heat dissipation toward the support substrate to increase the thermal efficiency of the thermal head while maintaining the printing quality. Note that, the thin plate glass may be formed to have a desired thickness by wet etching, dry etching, or the like.

According to a second aspect of the present invention, there is provided a printer including the above-mentioned thermal head.

Because the printer includes the above-mentioned thermal head, while maintaining the printing quality, the thermal efficiency of the thermal head may be increased to reduce an amount of energy required for printing. Therefore, printing on thermal paper may be performed with low power to prolong battery duration. Besides, a failure due to the breakage of the thermal head may be prevented to enhance device reliability.

The present invention provides an effect that the thermal head including the intermediate layer between the support substrate and the upper substrate is capable of suppressing the heat dissipation toward the support substrate while maintaining the printing quality.

DETAILED DESCRIPTION OF THE PREFERRED EMBODIMENT

Now, a thermal head 1 and a thermal printer 10 according to an embodiment of the present invention are described below with reference to the accompanying drawings.

Figure 1:
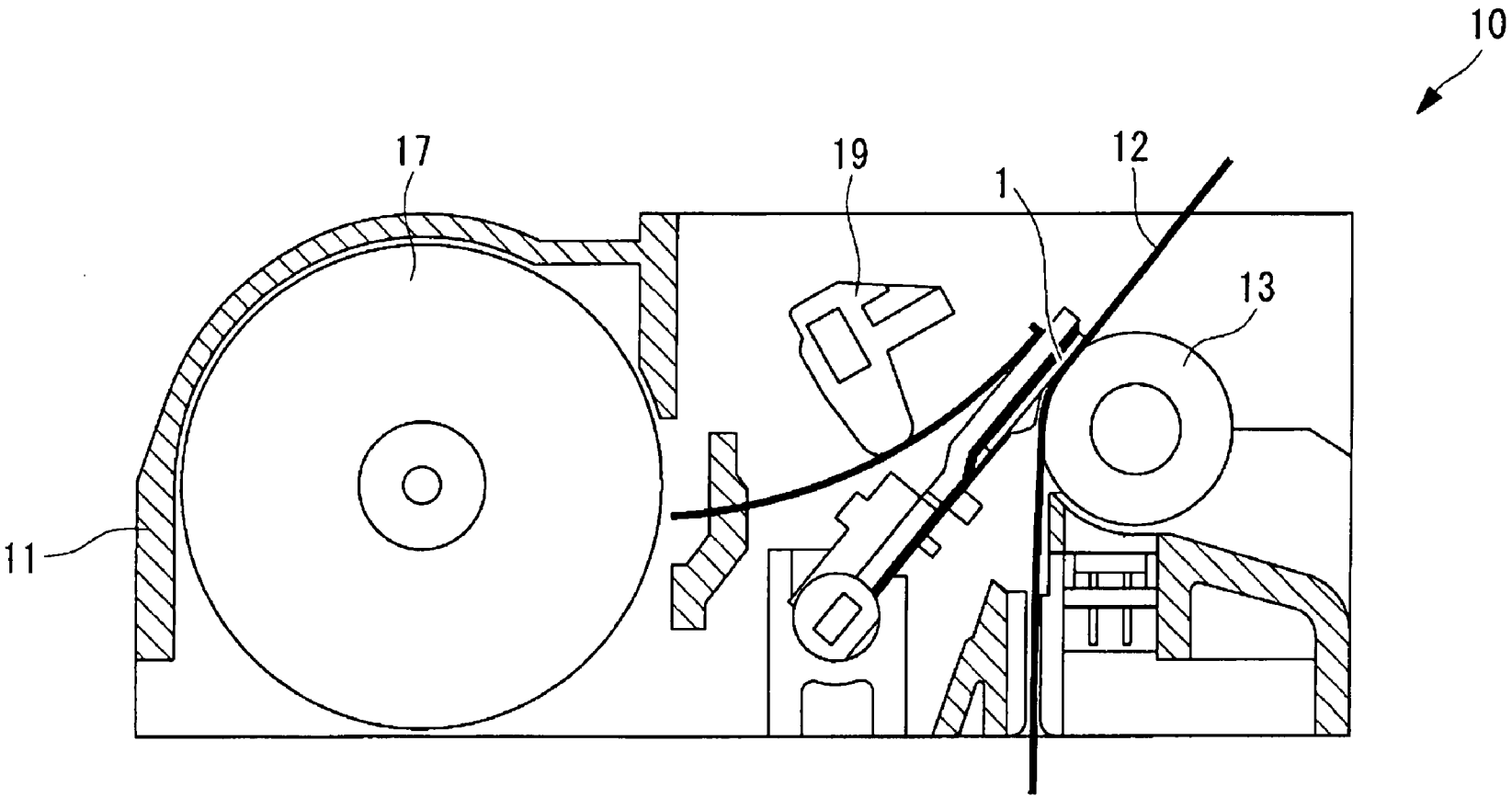
FIG. 1 is a schematic structural view of a thermal printer according to an embodiment of the present invention.

The thermal head 1 according to this embodiment is used for, for example, the thermal printer 10 as illustrated in FIG. 1, and performs printing on an object to be printed, such as thermal paper 12, by selectively driving a plurality of heating elements based on printing data.

The thermal printer 10 includes a main body frame 11, a platen roller 13 disposed with its central axis being horizontal, the thermal head 1 disposed so as to be opposed to an outer peripheral surface of the platen roller 13, a heat dissipation plate 15 (see FIG. 3) supporting the thermal head 1, a paper feeding mechanism 17 for feeding the thermal paper 12 between the platen roller 13 and the thermal head 1, and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. Accordingly, a reaction force from the platen roller 13 is applied to the thermal head 1 via the thermal paper 12.

The heat dissipation plate 15 is a plate-shaped member made of a metal such as aluminum, a resin, ceramics, glass, or the like, and serves for fixation and heat dissipation of the thermal head 1.

Figure 2:
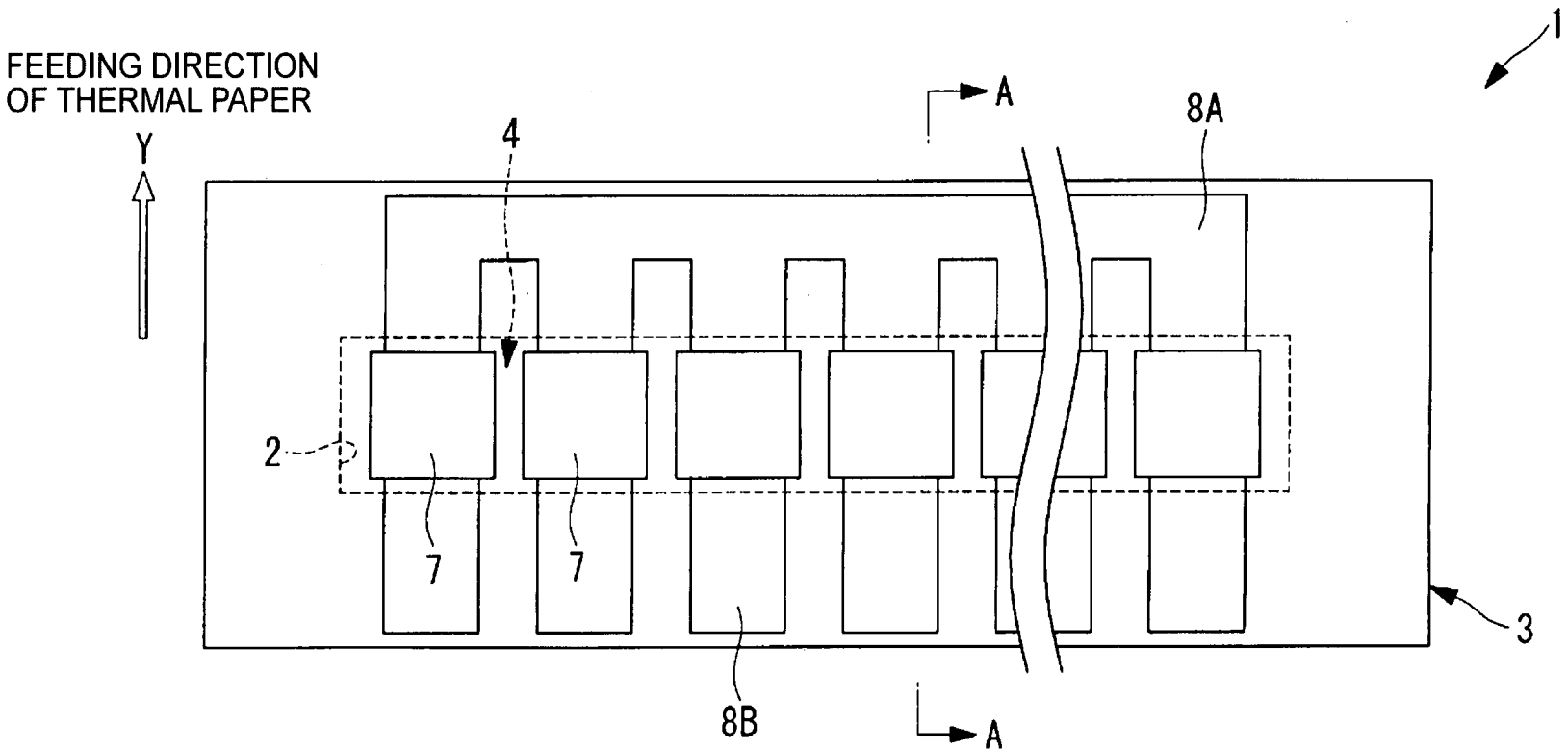
FIG. 2 is a plan view of a thermal head of FIG. 1 viewed from a protective film side.

As illustrated in FIG. 2, in the thermal head 1, a plurality of heating resistors 7 and a plurality of electrode portions 8 are arrayed in a longitudinal direction of a rectangular support substrate 3. The arrow Y represents a feeding direction of the thermal paper 12 by the paper feeding mechanism 17. Further, in an intermediate layer 6 described later, a rectangular concave portion 2 is formed extending in the longitudinal direction of the support substrate 3.

Figure 3:
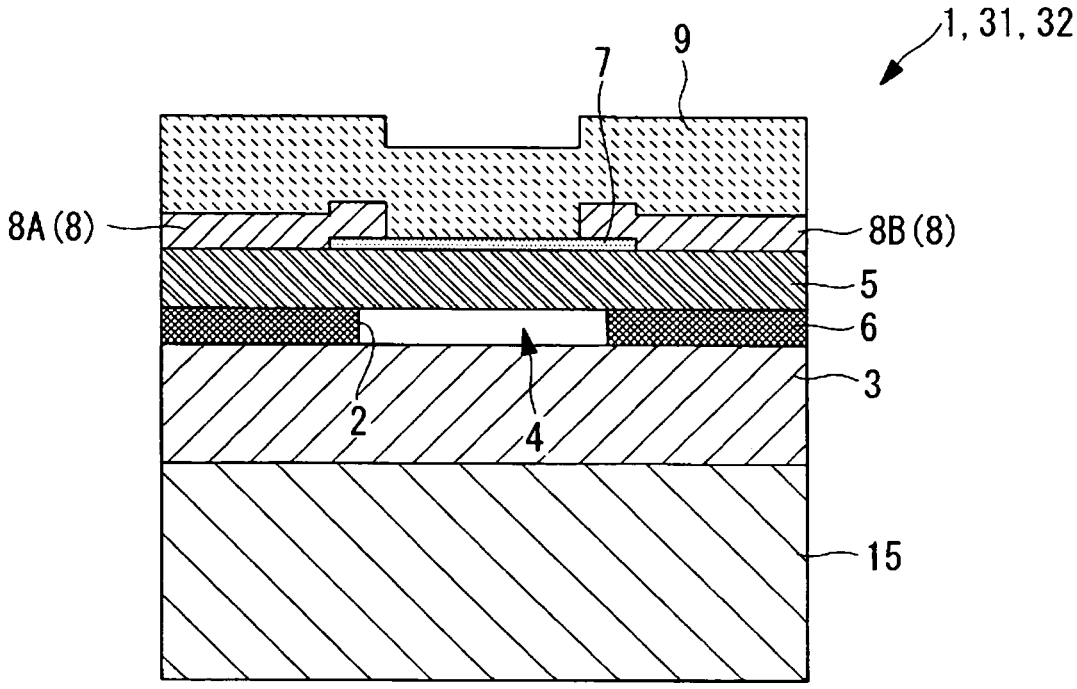
FIG. 3 is a cross-sectional view taken along the arrow A-A of the thermal head of FIG. 2.

FIG. 3 illustrates a cross-section taken along the arrow A-A of FIG. 2.

As illustrated in FIG. 3, the thermal head 1 includes the support substrate 3 supported by the heat dissipation plate 15, an upper substrate 5 bonded in a stacked state on an upper end surface side of the support substrate 3, the intermediate layer 6 formed between the upper substrate 5 and the support substrate 3, the heating resistors 7 provided on the upper substrate 5, the electrode portions 8 provided on both sides of the heating resistors 7, and a protective film 9 covering the heating resistors 7 and the electrode portions 8 to protect the heating resistors 7 and the electrode portions 8 from abrasion and corrosion.

The support substrate 3 is, for example, an insulating substrate such as a glass substrate or a silicon substrate having a thickness approximately ranging from 300 μm to 1 mm. Used herein as the support substrate 3 is a ceramic plate containing an alumina component of 99.5%.

The intermediate layer 6 is formed of a plate-shaped low-melting glass having a lower melting point than melting points of the support substrate 3 and the upper substrate 5. Employed herein as the intermediate layer 6 is a low-melting glass having a melting point ranging from 350° C. to 450° C. The intermediate layer 6 is formed of a plurality of laminated thin film layers of glass pastes by screen printing, to have a thickness equal to or larger than 50 μm and equal to or smaller than 100 μm.

The glass paste contains a powder-like low-melting glass and an organic medium for dispersion thereof.

The low-melting glass refers to glass whose glass-transition temperature is about 600° C. or lower. Such glass is widely used for electronic components for the purposes of insulation, sealing, bonding, and the like. Conventionally, lead-borosilicate-based glass is widely used. In recent years, however, the development of lead-free products is advanced to reduce environmental impact. Specifically, PbO—$B_2O_3$-based lead glass is mainly used. However, examples of the low-melting lead-free glass materials to be used include a $P_2O_5$—ZnO-alkali metal oxide-based material, a $P_2O_5$—$WO_3$-alkali metal oxide-based material, a SnO—$P_2O_5$—ZnO-based material, a CuO—$P_2O_5$-based material, a SnO—$P_2O_5$—$B_2O_3$-based material, a $Bi_2O_3$—$B_2O_3$—$SiO_2$—$Al_2O_3$—CeO-based material, a $Bi_2O_3$—$B_2O_3$—ZnO-based material, a SnO—$P_2O_5$—Cl-based material, a $B_2O_3$—ZnO—BaO—SnO-based material, a $B_2O_3$—ZnO—BaO—$Na_2O$-based material, a $SiO_2$—$B_2O_3$—ZnO—BaO-alkali metal oxide-based material, and a $B_2O_3$—$Bi_2O_3$—BaO-based material.

The organic medium is formed of an organic polymeric binder and a volatile organic solvent. The organic polymeric binder is selected from the group consisting of ethyl cellulose, ethyl hydroxyethyl cellulose, wood rosin, a mixed product of ethyl cellulose and a phenol resin, polymethacrylic ester of lower alcohol, monobutyl ether of ethylene glycol monoacetate, and a mixed product thereof. The volatile organic solvent is selected from the group consisting of ethyl acetate, terpene, kerosene, dibutyl phthalate, butyl carbitol, butyl carbitol acetate, hexylene glycol, a high-boiling point alcohol, an alcohol ester, and a mixed product thereof.

In an upper end surface of the intermediate layer 6, that is, at an interface between the intermediate layer 6 and the upper substrate 5, the rectangular concave portion 2 extending in the longitudinal direction of the support substrate 3 is formed in a region corresponding to the heating resistors 7. The concave portion 2 is, for example, a groove with a depth approximately ranging from 1 μm to 100 μm and a width approximately ranging from 50 μm to 300 μm. Note that, the concave portion 2 may be formed at a smaller thickness than that of the intermediate layer 6, or alternatively at the same thickness as that of the intermediate layer 6, that is, may be formed so as to pass through the intermediate layer 6.

The upper substrate 5 is formed of, for example, a glass material with a thickness approximately ranging from 10 μm to 100 μm±5 μm, and functions as a heat storage layer that stores heat generated from the heating resistors 7. Used herein as the upper substrate 5 is an alkali-free glass with a thickness of 50 μm. The upper substrate 5 is bonded in a stacked state to the front surface of the intermediate layer 6 so as to hermetically seal the concave portion 2. The concave portion 2 of the intermediate layer 6 is covered with the upper substrate 5, to thereby form a cavity portion 4 between the upper substrate 5 and the support substrate 3.

The cavity portion 4 has a communication structure opposed to all the heating resistors 7. The cavity portion 4 functions as a hollow heat-insulating layer that prevents the heat, which is generated from the heating resistors 7, from transferring to the support substrate 3 via the upper substrate 5. Because the cavity portion 4 functions as the hollow heat-insulating layer, a larger amount of heat, which transfers to the above of the heating resistors 7 and is utilized for printing and the like, may be obtained than an amount of heat, which transfers to the support substrate 3 via the upper substrate 5 located under the heating resistors 7. Accordingly, thermal efficiency of the thermal head 1 may be increased.

The heating resistors 7 are each provided on an upper end surface of the upper substrate 5 so as to straddle the concave portion 2 in its width direction, and are arrayed at predetermined intervals in a longitudinal direction of the concave portion 2. In other words, each of the heating resistors 7 is provided so as to be opposed to the cavity portion 4 through the intermediation of the upper substrate 5, and is situated above the cavity portion 4.

The electrode portions 8 supply the heating resistors 7 with current to allow the heating resistors 7 to generate heat. As illustrated in FIG. 2, the electrode portions 8 include a common electrode 8A connected to one end of each of the heating resistors 7 in a direction orthogonal to the array direction of the heating resistors 7, and individual electrodes 8B connected to another end of each of the heating resistors 7. The common electrode 8A is integrally connected to all the heating resistors 7, and the individual electrodes 8B are connected to the heating resistors 7 individually.

When voltage is selectively applied to the individual electrodes 8B, current flows through the heating resistors 7 which are connected to the selected individual electrodes 8B and the common electrode 8A opposed thereto, to thereby allow the heating resistors 7 to generate heat. In this state, the pressure mechanism 19 operates to press the thermal paper 12 against a surface portion (printing portion) of the protective film 9 covering heating portions of the heating resistors 7, and then color is developed on the thermal paper 12 to be printed.

Note that, of each of the heating resistors 7, an actually heating portion is a portion of each of the heating resistors 7 where the electrode portion 8A or 8B does not overlap, that is, a region of each of the heating resistors 7 between the connecting surface of the common electrode 8A and the connecting surface of each of the individual electrodes 8B, which is situated substantially directly above the cavity portion 4.

Next, a manufacturing method for the thermal head 1 having the above-mentioned structure is described below.

The manufacturing method for the thermal head 1 according to this embodiment includes an intermediate layer forming step of forming the intermediate layer 6 on the front surface of the support substrate 3, an opening portion forming step of forming an opening portion (concave portion 2) in the front surface of the intermediate layer 6, a bonding step of bonding the rear surface of the upper substrate 5 in a stacked state to the front surface of the intermediate layer 6 having the concave portion 2 formed therein, a thinning step of thinning the upper substrate 5 bonded to the support substrate 3, a resistor forming step of forming the heating resistors 7 on the front surface of the upper substrate 5 in a region corresponding to the cavity portion 4, an electrode layer forming step of forming the electrode portions 8 at both ends of the heating resistors 7, and a protective film forming step of forming the protective film 9 over the electrode portions 8. Hereinafter, the above-mentioned steps are specifically described.

In the intermediate layer forming step, the upper end surface (front surface) of the support substrate 3 is subjected to screen printing using a glass paste having a melting point ranging from 350° C. to 450° C. Specifically, in the screen printing, using a screen mask in which a similar pattern to the shape of the cavity (concave portion 2) is formed, printing is performed under optimum paste conditions and printing conditions. Then, the resultant is dried in an oven (at 100° C. to 120° C.) to remove a volatile organic medium, and thereafter baked subsequently, to thereby obtain a thin film layer with a thickness approximately ranging from 5 μm to 20 μm. This step is repeated a plurality of times to laminate a plurality of the thin film layers of the glass pastes, to form the intermediate layer 6 at a thickness equal to or larger than 50 μm and equal to or smaller than 100 μm.

Note that, in the opening portion forming step, the concave portion 2 may be formed at the position corresponding to the region for providing the heating resistors 7 in the upper end surface (front surface) of the intermediate layer 6, which is formed of the plurality of laminated thin film layers of the glass pastes in which the cavity (concave portion 2) is not formed. In this case, the concave portion 2 is formed in the front surface of the intermediate layer 6 by, for example, sandblasting, dry etching, wet etching, or laser machining.

In the case where sandblasting is performed on the intermediate layer 6, the front surface of the intermediate layer 6 is covered with a photoresist material, and the photoresist material is exposed to light using a photomask of a predetermined pattern so as to be cured in part other than the region for forming the concave portion 2. After that, the front surface of the intermediate layer 6 is cleaned and the uncured photoresist material is removed to obtain an etching mask (not shown) having an etching window formed in the region for forming the concave portion 2. In this state, sandblasting is performed on the front surface of the intermediate layer 6 to form the concave portion 2 at a depth ranging from 1 μm to 100 μm.

Alternatively, in the case of performing etching such as dry etching or wet etching, similarly to the above-mentioned processing by sandblasting, the etching mask having the etching window formed in the region for forming the concave portion 2 is formed on the front surface of the intermediate layer 6. In this state, etching is performed on the front surface of the intermediate layer 6 to form the concave portion 2 at a depth ranging from 1 μm to 100 μm.

As such an etching process, for example, wet etching using a hydrofluoric acid-based etchant or the like is available, as well as dry etching such as reactive ion etching (RIE) and plasma etching. Note that, as a reference example, in a case where the intermediate layer 6 is formed of single-crystal silicon, wet etching is performed using an etchant such as a tetramethylammonium hydroxide solution, a KOH solution, or a mixed solution of hydrofluoric acid and nitric acid.

Next, in the bonding step, a lower end surface (rear surface) of the upper substrate 5, which is a glass substrate or the like with a thickness approximately ranging from 500 μm to 700 μm, is stacked to the upper end surface (front surface) of the intermediate layer 6 having the concave portion 2 formed therein, and then heat treatment is performed. At this time, the heat treatment is performed at a temperature equal to or higher than the melting point of the intermediate layer 6 (350° C. to 450° C.) and lower than the melting points of the upper substrate 5 and the support substrate 3. Such heat treatment enables the intermediate layer 6 to be melted to function as a bonding material for bonding the upper substrate 5 and the support substrate 3.

When the support substrate 3 and the upper substrate 5 are bonded to each other, the concave portion 2 formed in the intermediate layer 6 is covered with the upper substrate 5 to form the cavity portion 4 between the support substrate 3 and the upper substrate 5.

Here, it is difficult to manufacture and handle an upper substrate having a thickness of 100 μm or less, and such a substrate is expensive. Thus, instead of directly bonding an originally thin upper substrate 5 onto the intermediate layer 6, the upper substrate 5 which is thick enough to be easily manufactured and handled in the bonding step is bonded onto the intermediate layer 6, and then the upper substrate 5 is processed in the thinning step so as to have a desired thickness.

Next, in the thinning step, mechanical polishing is performed on the upper end surface (front surface) of the upper substrate 5 to process the upper substrate 5 to be thinned to, for example, about 1 μm to 100 μm. Note that, the thinning process may be performed by dry etching, wet etching, or the like.

Next, the heating resistors 7, the common electrode 8A, the individual electrodes 8B, and the protective film 9 are successively formed on the upper substrate 5.

Specifically, in the resistor forming step, a thin film forming method such as sputtering, chemical vapor deposition (CVD), or vapor deposition is used to form a thin film of a heating resistor material on the upper substrate 5, such as a Ta-based thin film or a silicide-based thin film. The thin film of the heating resistor material is molded by lift-off, etching, or the like to form the heating resistors 7 of a desired shape.

Next, in the electrode layer forming step, a film of a wiring material such as Al, Al—Si, Au, Ag, Cu, or Pt is deposited on the upper substrate 5 by sputtering, vapor deposition, or the like. Then, the film thus obtained is formed by lift-off or etching, or alternatively the wiring material is baked after screen printing, to thereby form the common electrode 8A and the individual electrodes 8B of desired shapes. Note that, in order to pattern a resist material for the lift-off or etching for the heating resistors 7 and the electrode portions 8A and 8B, a photoresist material is patterned using a photomask.

Next, in the protective film forming step, a film of a protective film material such as $SiO_2$, $Ta_2O_5$, SiAlON, $Si_3N_4$, or diamond-like carbon is deposited on the upper substrate 5 by sputtering, ion plating, CVD, or the like to form the protective film 9. This way, the thermal head 1 illustrated in FIG. 3 is manufactured.

As described above, according to the thermal head 1 of this embodiment, the upper substrate 5 provided with the heating resistors 7 functions as the heat storage layer that stores heat generated from the heating resistors 7. Further, the intermediate layer 6 having the concave portion 2 that forms the cavity portion 4 is provided between the upper substrate 5 and the support substrate 3 which are bonded to each other in the stacked state, to thereby form the cavity portion 4 between the support substrate 3 and the upper substrate 5. The cavity portion 4 is formed in the region corresponding to the heating resistors 7 and functions as a heat-insulating layer that blocks the heat generated from the heating resistors 7. Therefore, according to the thermal head 1 of this embodiment, the heat generated from the heating resistors 7 may be prevented from transferring and dissipating toward the support substrate 3 via the upper substrate 5. As a result, use efficiency of the heat generated from the heating resistors 7, that is, thermal efficiency of the thermal head 1 may be increased.

Here, the intermediate layer 6 is formed, of the plate-shaped glass material having a lower melting point than the melting points of the upper substrate 5 and the support substrate 3. Accordingly, the intermediate layer 6 may be melted within such a temperature range as not to deform the upper substrate 5 or the support substrate 3, to bond the upper substrate 5 and the support substrate 3 to each other. Then, because the intermediate layer 6 is formed of the plate-shaped glass material, the intermediate layer 6 may be formed at a predetermined thickness so that the heat dissipation toward the support substrate 3 is reduced to increase the thermal efficiency of the thermal head 1 while maintaining printing quality. Further, because the intermediate layer 6 is formed of the glass material, the intermediate layer 6 may have the same coefficient of thermal expansion as that of the upper substrate 5, to thereby suppress lowering in bonding force to the upper substrate 5 due to thermal transformation or thermal stress.

Further, because the glass paste is subjected to screen printing, the thin film layer with a thickness approximately ranging from 5 μm to 20 μm may be formed. Then, when the screen printing is performed a plurality of times to laminate a plurality of the thin film layers, the intermediate layer 6 may be formed at a thickness equal to or larger than 50 μm and equal to or smaller than 100 μm. Therefore, the heat dissipation toward the support substrate 3 may be reduced to increase the thermal efficiency of the thermal head 1 while maintaining the printing quality.

The thermal printer 10 described above includes the above-mentioned thermal head 1, and hence while maintaining the printing quality, the thermal efficiency of the thermal head 1 may be increased to reduce an amount of energy required for printing. Therefore, printing on the thermal paper 12 may be performed with low power to prolong battery duration. Besides, a failure due to the breakage of the thermal head 1 may be prevented to enhance device reliability.

First Modified Example

A first modified example of the thermal head 1 according to this embodiment is described below.

A thermal head 31 according to this modified example is different from the thermal head 1 according to the above-mentioned embodiment in that the intermediate layer 6 is formed of at least one laminated green sheet. The description common to the thermal head 1 according to the above-mentioned embodiment is omitted below, and hence the following description is mainly directed to the difference.

A green sheet is what is obtained by mixing an organic binder and a solvent into glass powders, which are ground into a constant micro grain diameter, and by sheeting the resultant slurry by a film-forming apparatus. Here, in order to adjust the characteristics of glass, a green sheet is manufactured in the following way. The above-mentioned low-melting glass powders and other glass powders are mixed at a predetermined ratio, and an organic binder and the like are added to the mixture. After that, doctor blading, rolling, pressing, or the like is performed to mold the mixture into a sheet shape.

Examples of the glass powder include powders of silica glass, soda-lime glass, lead glass, lead alkali silicate glass, borosilicate glass, alumino-borosilicate glass, borosilicate zinc glass, alumino-silicate glass, and phosphate glass. Examples of the organic binder include a product prepared by adding dibutyl phthalate (DBP) as a plasticizer, toluene as a solvent, and the like to an acrylic resin.

A method of forming the concave portion 2 in the intermediate layer 6 using the above-mentioned green sheet is described below.

First, the organic binder and the solvent are added and mixed into the low-melting glass powders to obtain a slurry with an appropriate viscosity, and the slurry is formed into a thin film with a predetermined thickness considering the degree of shrinkage, which is then dried. A green sheet thus formed is cut into a predetermined size considering the size of the upper substrate 5 and the support substrate 3. Then, using a punching die processed into a similar pattern to the shape of the concave portion 2, the concave portion 2 is formed in the green sheet. At least one green sheet is laminated to form the intermediate layer 6 at a thickness equal to or larger than 50 μm and equal to or smaller than 100 μm. Note that, the concave portion 2 may be formed by cutting or laser, apart from the above-mentioned punching die.

As described above, according to the thermal head 31 of this modified example, the intermediate layer 6 is formed of at least one laminated sheet-shaped green sheet, and hence process accuracy on the thickness of the intermediate layer 6 may be increased. Therefore, the intermediate layer 6 may easily be formed at a thickness equal to or larger than 50 μm and equal to or smaller than 100 μm, to thereby reduce the heat dissipation toward the support substrate 3 to increase the thermal efficiency of the thermal head 1 while maintaining the printing quality.

Second Modified Example

A second modified example of the thermal head 1 according to this embodiment is described below.

A thermal head 32 according to this modified example is different from the thermal head 1 according to the above-mentioned embodiment in that the intermediate layer 6 is formed using a thin plate glass. The description common to the thermal head 1 according to the above-mentioned embodiment is omitted below, and hence the following description is mainly directed to the difference.

Used herein as the thin plate glass is one obtained by processing a low-melting glass plate to have a desired thickness under an appropriate wet etching condition. Alternatively, low-melting glass powders and other glass powders are mixed at a predetermined ratio and processed into a plate shape, and thereafter thinning may be performed by wet etching, mechanical polishing, rolling accompanied by heating, or the like.

A method of forming the concave portion 2 in the intermediate layer 6 using the above-mentioned thin plate glass is described below.

First, sputtering is performed to deposit a metal film, such as a chromium film, on the thinned low-melting glass plate. Using a photomask in which a similar pattern to the shape of the concave portion 2 is formed, the resultant glass plate is subjected to photolithography and glass etching to form the concave portion 2. After that, the metal film and the photomask are removed to obtain the intermediate layer 6 with a desired thickness. Note that, the concave portion 2 may be formed by sandblasting or laser, apart from the above-mentioned etching.

As described above, according to the thermal head 32 of this modified example, the intermediate layer 6 is formed of the thin plate glass formed into the thin plate shape, and hence process accuracy on the thickness of the intermediate layer 6 may be increased. Therefore, the intermediate layer 6 may easily be formed at a thickness equal to or larger than 50 μm and equal to or smaller than 100 μm, to thereby reduce the heat dissipation toward the support substrate 3 to increase the thermal efficiency of the thermal head 1 while maintaining the printing quality. Note that, the thin plate glass may be formed to have a desired thickness by wet etching, dry etching, or the like.

Hereinabove, the embodiment of the present invention has been described in detail with reference to the accompanying drawings. However, specific structures of the present invention are not limited to the embodiment and encompass design modifications and the like without departing from the gist of the present invention.

For example, in the above description, the rectangular concave portion 2 extending in the longitudinal direction of the support substrate 3 is formed, and the cavity portion 4 has the communication structure opposed to all the heating resistors 7, but as an alternative thereto, concave portions independent of one another may be formed in the longitudinal direction of the support substrate 3 at positions corresponding to the heating resistors 7, and cavity portions independent for each concave portion may be formed through closing the respective concave portions by the upper substrate 5. In this manner, a thermal head including a plurality of hollow heat-insulating layers independent of one another may be formed.

What is claimed is:

1. A thermal head, comprising:

an upper substrate;

a support substrate bonded in a stacked state on one surface side of the upper substrate;

a heating resistor provided on another surface side of the upper substrate; and an intermediate layer having a concave portion that forms a cavity portion in a region corresponding to the heating resistor, the intermediate layer being provided between the upper substrate and the support substrate, wherein the intermediate layer is formed of a plate-shaped glass material having a lower melting point than melting points of the upper substrate and the support substrate.

2. A thermal head according to claim 1, wherein the intermediate layer is formed at a thickness equal to or larger than 50 μm and equal to or smaller than 100 μm.

3. A thermal head according to claim 1, wherein the intermediate layer is formed of a plurality of laminated thin film layers of glass pastes by screen printing.

4. A thermal head according to claim 2, wherein the intermediate layer is formed of a plurality of laminated thin film layers of glass pastes by screen printing.

5. A thermal head according to claim 1, wherein the intermediate layer is formed of at least one laminated green sheet which is formed by sheeting a mixed material of glass powders and a binder.

6. A thermal head according to claim 2, wherein the intermediate layer is formed of at least one laminated green sheet which is formed by sheeting a mixed material of glass powders and a binder.

7. A thermal head according to claim 1, wherein the intermediate layer comprises a thin plate glass formed into a thin plate shape.

8. A thermal head according to claim 2, wherein the intermediate layer comprises a thin plate glass formed into a thin plate shape.

9. A printer, comprising the thermal head according to claim 1.

* * * * *